US008186856B2

(12) United States Patent
Tahmosybayat

(10) Patent No.: US 8,186,856 B2
(45) Date of Patent: May 29, 2012

(54) THERMALLY MANAGED LAMP ASSEMBLY

(76) Inventor: Ghollam Tahmosybayat, Tyne & Wear (GB)

( * ) Notice: Subject to any disclaimer, the term of this patent is extended or adjusted under 35 U.S.C. 154(b) by 250 days.

(21) Appl. No.: 12/442,905

(22) PCT Filed: Sep. 26, 2007

(86) PCT No.: PCT/GB2007/003663
§ 371 (c)(1),
(2), (4) Date: Feb. 2, 2010

(87) PCT Pub. No.: WO2008/037992
PCT Pub. Date: Apr. 3, 2008

(65) Prior Publication Data

US 2010/0142212 A1 Jun. 10, 2010

(30) Foreign Application Priority Data

Sep. 26, 2006 (WO) ..... PCT/GB2006/003566

(51) Int. Cl.
*F21V 29/02* (2006.01)

(52) U.S. Cl. ..... 362/373; 362/294

(58) Field of Classification Search ..... 362/218, 362/294, 373
See application file for complete search history.

(56) References Cited

U.S. PATENT DOCUMENTS

| | | | | |
|---|---|---|---|---|
| 5,632,551 | A | 5/1997 | Roney et al. | |
| 6,095,671 | A | 8/2000 | Hutain | |
| 2002/0191403 | A1 * | 12/2002 | Zhang et al. | 362/373 |
| 2004/0120152 | A1 | 6/2004 | Bolta et al. | |
| 2005/0174780 | A1 * | 8/2005 | Park | 362/294 |
| 2006/0193139 | A1 * | 8/2006 | Sun et al. | 362/373 |

FOREIGN PATENT DOCUMENTS

EP 1471564 10/2004

OTHER PUBLICATIONS

European Search Report for EP 07804402.1.

* cited by examiner

*Primary Examiner* — David V Bruce
(74) *Attorney, Agent, or Firm* — Rader, Fishman & Grauer PLLC

(57) ABSTRACT

A lamp assembly comprises at least one light source such as a high-power LED (106), a housing (heat sink (108), metal base (109) with holes (126), lens (118)) in or on which the light source is located, and a fan (120) adapted to produce a current of air to cool the light source. The fan is arranged to draw air away from the light source through the holes (126) and to eject it from the housing; to this end the fan is preferably located directly underneath the light source in a self-contained package.

21 Claims, 2 Drawing Sheets

THERMALLY MANAGED LAMP ASSEMBLY

CROSS-REFERENCE TO RELATED APPLICATIONS

This application is a U.S. National Phase of PCT/GB2007/003663, filed Sep. 26, 2007 which claims priority from International Application PCT/GB2006/003566, filed Sep. 26, 2006, both of which are hereby incorporated by reference in their entirety.

TECHNICAL FIELD

The present invention relates to a lamp assembly, and relates particularly, but not exclusively, to means for conducting heat generated by the light source of the lamp assembly away from the light source.

BACKGROUND

LEDs have several advantages over conventional filament or halogen bulbs. Since LEDs do not have a filament, the filament cannot burn out, which gives an LED longer life compared with both filament and halogen bulbs. However, LEDs generally emit less light than filament and halogen bulbs. To overcome this disadvantage, a type of LED lamp uses several individual low power LEDs to increase light output of the lamp.

It is desirable to use a single high-power LED in a lamp assembly rather than several low-power LEDs. However, an array of low-power LEDs generates a lower power density than lamp assemblies comprising a single high-power LED and so is easier to keep cool. A known type of lamp assembly comprising a single high-power LED comprises a metal housing in which the LED is mounted, the metal housing conducting the heat away from the LED. For heat-sinking configurations one may consult, for instance, US 2003/0040200 A1. "High-power" typically means ≧150 mA, "low-power" usually in the range 10-20, or say ≦50 mA.

It is also desirable to use high-power LEDs mounted in lamp assemblies that are formed from materials other than metal, such as glass, for decorative purposes. However, these materials do not conduct heat as well as metal, and can lead to the problem of heat building up near the LED, which can burn the LED out or in some cases lead to melting or fire. In general, the thermal properties of LED packaging are inadequately addressed in the prior art.

SUMMARY

According to the present invention, there is provided a lamp assembly comprising a light source, a housing or mounting, in or on which the light source is located and at least one fan adapted to produce a current of air to cool the light source;

wherein the fan is arranged to draw air away from the light source and eject it from the mounting.

To this end the fan may be located preferably within one fan diameter or so of the light source, and preferably with the light source lying on the fan axis. It may be within or at an open end of the housing.

This provides the advantage that a wider range of materials can be used to form the lamp assembly since the fan cools the light source effectively. It has been shown that use of a heat sink in the known way can reduce steady-state operating temperature from 100° C. to 80° C., while adding a fan in accordance with the invention reduces it to about 40° C.

In a preferred embodiment, the light source is a high-power LED. This provides the advantage that the high-power LED has a longer lifetime and is more energy-efficient than other types of light source such as halogen and filament bulbs.

The light source may be mounted on a heat sink, the heat sink having at least one hole or being otherwise permeable to allow air flow through it when the fan operates. This provides the advantage of increasing the heat conduction away from the light source.

The light source and the fan may be powered by the same power supply, which reduces the number of components required for the lamp assembly, therefore reducing cost.

The assembly may make use of a bonding material for attaching the light source to the mounting, wherein the bonding material is adapted to conduct heat generated by the light source to the body.

The assembly may further comprise a circuit for controlling the light source. In a preferred embodiment, the circuit is adapted to enable the light source to be powered by mains AC. It may also be adapted to enable bipolarity of the lamp assembly, which means that the lamp assembly can be used with pre-existing light sockets.

The lamp assembly may further include a reflector surrounding the light source, and/or a lens arrangement for diverging the light output.

BRIEF DESCRIPTION OF THE DRAWINGS

Preferred embodiments of the present invention will now be described, by way of example only and not in any limitative sense, with reference to the accompanying drawings, in which.

DETAILED DESCRIPTION

Figure 1:
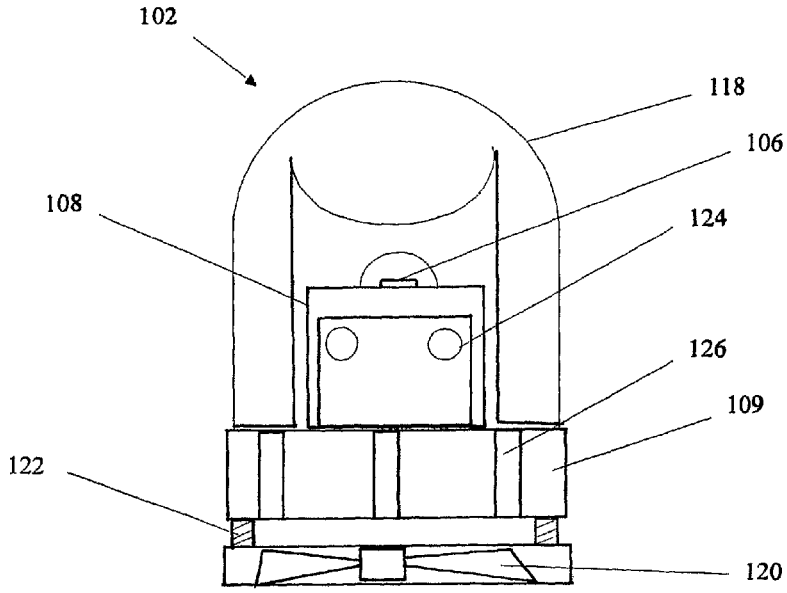
FIG. 1 is a cross-sectional view of a lamp assembly of a first embodiment of the present invention.

A first embodiment of the lamp assembly is shown in FIG. 1.

An LED chip 106 is mounted on a heat sink 108. A lens 118 surrounds the LED chip 106, which is in the form of an inverted pot. The lens 118 may be of the type described in Patent application no. WO 2007/099275 by the inventor, spreading the light from the LED over a wide angle. The heat sink 108 is mounted on a metal part in the form of a disc-shaped baseplate 109. A fan 120 is mounted on the metal part 109 by screws 122 or other suitable fixings. A first plurality of holes 124 is formed in the cylindrical wall of the heat sink 108, preferably near its top (inverted base), and a second plurality of holes 126 is formed in the metal part 109. The lens, heat sink and metal part form a housing or mounting. The diameter of the housing might typically be, say, 10-20 mm, the fan similarly.

An electric fan 120 that is adapted to be powered by the same power supply (not shown) as the LED chip 106 is mounted on the bottom of the metal part 109 by an annular spacer 122. When the fan 120 is operated, air is sucked into the lamp assembly 102 and passes through holes 124, 126 to cause a cooling air current past LED chip 106, or at least past its heat sink. The warm air is then exhausted by the fan 120. The lamp assembly 102 can be mounted in a screw or bayonet fitting or other standard light fitting. Circuitry (not shown) is provided for converting main AC into a power supply suitable for powering both fan 120 and LED chip 106. The fan speed need be only low, perhaps a few hundred rpm.

The assembly is a compact unit, with the housing or mounting having a diameter of perhaps a centimeter or two, and the fan 120 having a diameter not much less. This diameter is comparable to, preferably at least half, the distance from fan to light source.

Figure 2A:
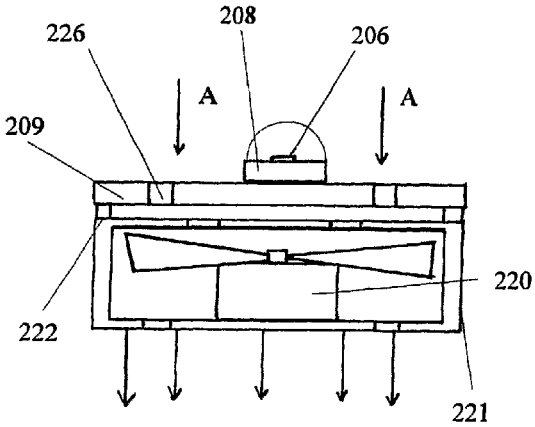
FIG. 2*a* is a cross-sectional view of a lamp assembly of a second embodiment of the present invention.

A second embodiment of the lamp assembly is shown in FIG. 2*a*, with parts common to the embodiment of FIG. 1 denoted with like reference numerals but increased by 100. A lens is not shown, though one may be present.

An LED chip 206 is mounted on a heat sink 208, here a flat plate of the same diameter as the encapsulation of the LED, the heat sink in turn being mounted—for instance by gluing or soldering—on a metal part or plate 209 having a plurality of holes 226. An electric fan 220 is mounted in a plastic housing 221 which is connected to the metal part 209 by screws 222. Operation of the fan 220 causes air to flow in the direction of arrows A past the LED chip 206 and through holes 226. The air is then expelled past the fan through the plastic fan housing 221, which has holes in its top and bottom walls.

Figure 2B:
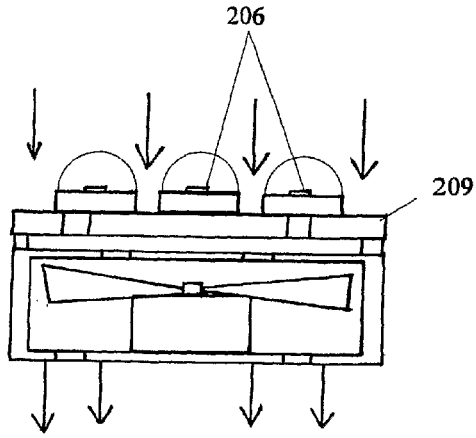
FIG. 2*b* is a cross-sectional view of a lamp assembly of a third embodiment of the present invention.

The embodiment of FIG. 2*b* is identical to that of FIG. 2*a*, except that a plurality of LED chips 206 are mounted on the metal part 209 to form a distributed light source. Three are shown, but more could be present in a planar array.

Figure 3A:
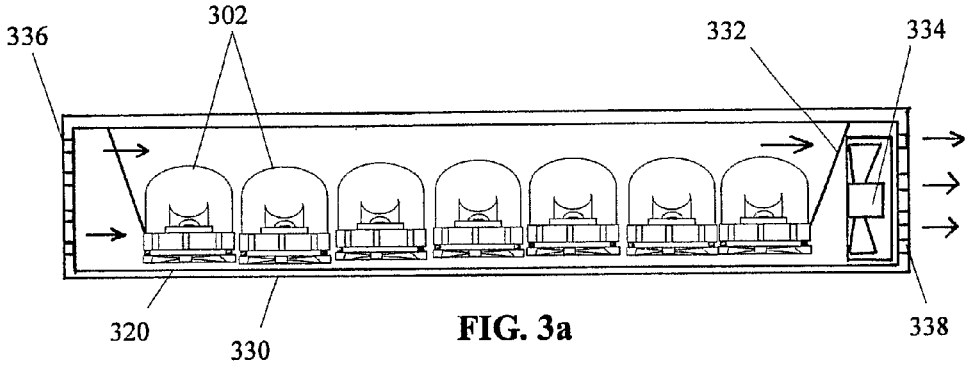
FIG. 3*a* is a cross-section view of a lamp assembly of a fourth embodiment of the present invention.
Figure 3B:
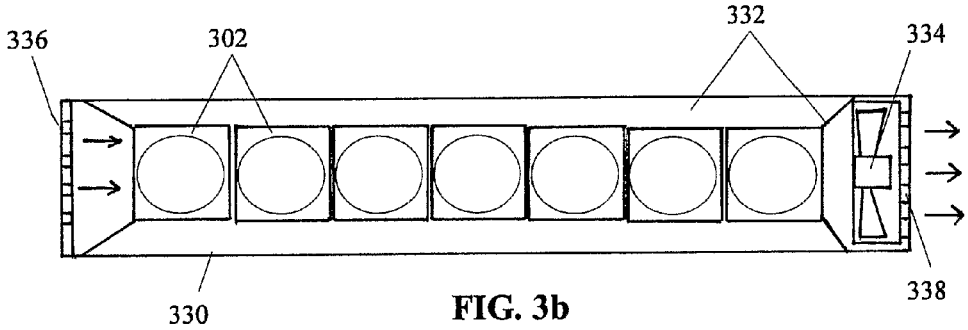
FIG. 3*b* is a plan view of the lamp assembly of FIG. 3*a;*

A fourth embodiment of the lamp assembly is shown in FIGS. 3*a* and 3*b*, with parts common to the embodiment of FIG. 1 denoted with like reference numerals but increased by 200.

A plurality of lamp assemblies 302 is mounted in a casing 330. Each of these is similar to the assembly 102 of FIG. 1. The casing 330 may comprise inclined reflector surfaces 332 adapted to reflect light outwardly of the casing 330. Each lamp assembly 302 comprises a first fan 320 and a larger second fan 334 is mounted in the casing 330. A first plurality of holes 336 is formed in a first side of casing 330 and a second plurality of holes 338 is formed in the other side of casing 330 such that, during operation of fan 334, air flows through the casing 330 cooling each individual lamp assembly 302. The lighting assemblies shown in FIGS. 3*a* and 3*b* are suitable for use as strip lighting, in place of the type of strip lighting that uses halogen tubes.

Preferably each individual lamp assembly 302 has its own fan, but a significant cooling effect can be achieved without, simply by virtue of the end fan 334, which has a diameter a little less than that of the interior of the tube-shaped casing 330 and hence draws air uniformly over the lamp assemblies 302. Here the casing 330 can be considered as the housing or mounting for the lamps 302.

Figure 4A:
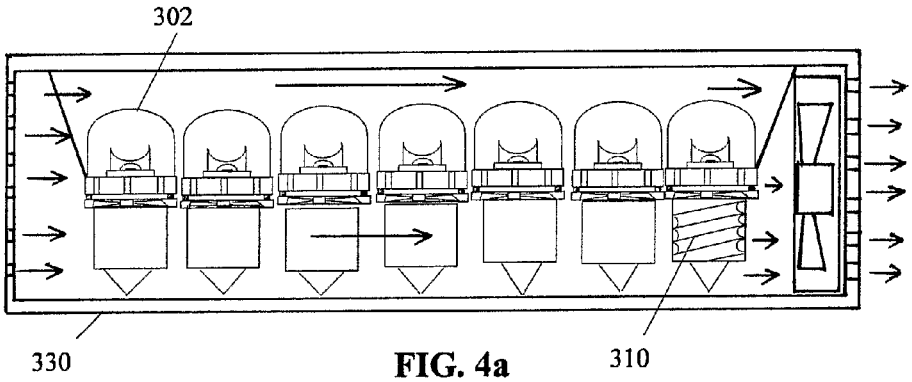
FIG. 4*a* is a cross-sectional view of a lamp assembly of a fifth embodiment of the present invention.
Figure 4B:
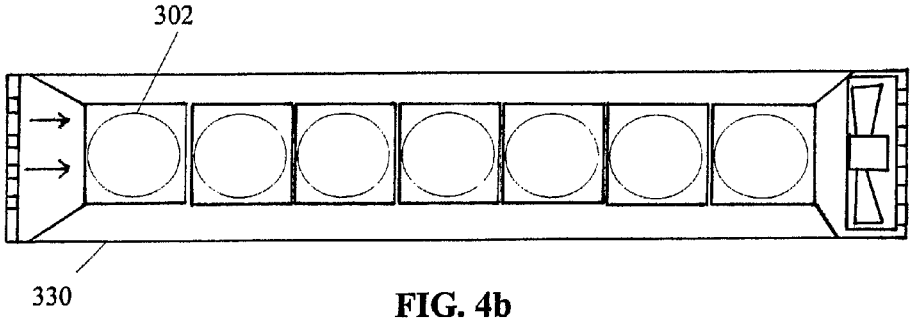
FIG. 4*b* is a plan view of the lamp assembly of FIG. 4*a*.

The embodiment shown in FIGS. 4*a* and 4*b* is identical to that of the embodiment of FIGS. 3*a* and 3*b* except each individual lamp 302 is mounted on the casing 330 by a screw fitting 310 to allow easy replacement of each individual lamp assembly 302. This kind of screw fitting is generally usable with lamps of the invention. Here the metal base plate 109 and the fan are somewhat wider than the screw fitting, to allow air to escape round the rim.

The invention thus concerns a lamp assembly comprising at least one light source such as a high-power LED 106, a housing (heat sink 108, metal base 109 with holes 126, lens 118) in or on which the light source is located, and a fan 120 adapted to produce a current of air to cool the light source. The fan is arranged to draw air away from the light source through the holes 126 and to eject it from the housing; to this end the fan is preferably located directly underneath the light source in a self-contained package.

It will be appreciated by persons skilled in art that the above embodiments have been described by way of example only, and not in any limitative sense, and that various alterations and modifications are possible without departure from the scope of the invention as defined by the appended claims. In particular, light sources other than high-power LEDs may be used, preferably such as operate better when cooled.

The invention claimed is:

1. A lamp assembly comprising:

a light source;

a fan adapted to produce a current of air to cool the light source; and a housing in which the light source is disposed, the housing including a baseplate on which the light source is mounted, the fan being mounted underneath the baseplate, and the baseplate having holes through which a fan draws air to cool the light source and ejects the air from the housing.

2. The assembly of claim 1, wherein the light source is a high-power LED.

3. The assembly of claim 1, wherein the light source is mounted on a heat sink, the heat sink having at least one hole to allow air flow through the at least one hole.

4. The assembly of claim 1, wherein the fan is mounted on the baseplate at a distance from the light source not substantially greater than a diameter of the fan.

5. The assembly of claim 1, wherein the light source lies on a fan axis.

6. The assembly of claim 1, wherein the baseplate mounted above the fan is metallic and disc-shaped.

7. The assembly of claim 3, wherein the fan is mounted on the baseplate at a distance from the light source not substantially greater than a diameter of the fan.

8. The assembly of claim 3, wherein the light source lies on a fan axis.

9. The assembly of claim 4, wherein the light source lies on a fan axis.

10. The assembly of claim 7, wherein the housing is generally cylindrical and the fan is arranged at an end of the housing, a diameter of the fan corresponding to an interior cross-section of the housing.

11. The assembly of claim 1, wherein the light source and the fan are arranged to be powered by a common power supply.

12. The assembly of claim 1, wherein the assembly further includes a circuit adapted to enable the light source to be powered by a main AC.

13. The assembly of claim 12, wherein the circuit is adapted to enable bipolarity of the lamp assembly.

14. The assembly of claim 1, wherein the assembly includes a plurality of light sources located in the housing.

15. The assembly of claim 1, wherein the housing is generally cylindrical and the fan is arranged at an end of the housing, a diameter of the fan corresponding to an interior cross-section of the housing.

16. A lamp apparatus including a plurality of lamp assemblies according to claim 1, further including a fan mounted in a casing.

17. The lamp assembly of claim 1, further comprising a lens disposed on an outer surface of the baseplate opposite the fan.

18. A lamp assembly comprising:

a light source mounted on a heat sink, the heat sink including at least one heat sink hole;

a baseplate having at least one baseplate hole, the heat sink mounted on the baseplate;

a housing in which the light source is disposed; and a fan disposed underneath the baseplate at a distance from the light source not substantially greater than a diameter of the fan and arranged such that the light source lies on a fan axis, the fan adapted to draw air through the at least one heat sink hole and the at least one baseplate hole to produce a current of air to cool the light source.

19. The lamp assembly of claim 18, wherein the baseplate mounted above the fan is metallic and disc-shaped.

20. The lamp assembly of claim 18, wherein the fan is disposed within the housing.

21. The lamp assembly of claim 18, wherein the fan is disposed at an open end of the housing.

* * * * *